US005087943A

United States Patent [19]

Creveling

[11] Patent Number: 5,087,943

[45] Date of Patent: Feb. 11, 1992

[54] OZONE REMOVAL SYSTEM

[75] Inventor: Clyde M. Creveling, Rochester, N.Y.

[73] Assignee: Eastman Kodak Company, Rochester, N.Y.

[21] Appl. No.: 625,190

[22] Filed: Dec. 10, 1990

[51] Int. Cl.[5] ..... G03G 15/00

[52] U.S. Cl. ..... 355/215; 55/472; 250/324; 355/221

[58] Field of Search ..... 355/215, 296, 219, 221; 55/387, 467, 472; 250/324, 325, 326

[56] References Cited

U.S. PATENT DOCUMENTS

| | | | |
|---|---|---|---|
| 3,332,328 | 7/1967 | Roth, Jr. | 355/215 X |
| 3,862,420 | 1/1975 | Banks et al. | 250/324 |
| 4,178,092 | 12/1979 | Yamamoto et al. | 355/221 X |
| 4,358,300 | 11/1982 | Schlapman et al. | 55/245 |
| 4,512,245 | 4/1985 | Goldman | 55/472 X |
| 4,652,114 | 3/1987 | Sobieski et al. | 355/296 X |
| 4,853,735 | 8/1989 | Kodama et al. | 355/215 |

*Primary Examiner*—Joan H. Pendegrass
*Assistant Examiner*—Shuk Y. Lee
*Attorney, Agent, or Firm*—Tallam I. Nguit

[57] ABSTRACT

Office machines, such as electrostatographic reproducing machines, laser printers, and facsimile machines, utilize corona discharge devices, which generate ozone. Some electrostatographic reproducing machines include a film belt arranged in a look having a plurality of such ozone generating corona discharge devices positioned therearound. In order to remove ozone from these machines at the locations where such ozone is generated, an ozone collection system is provided in which each corona device has a hood in proximity therewith connected by a hose to a manifold. The manifold is, in turn, connected by a hose to an ozone-removing canister which includes an air suction pump, a plenum, and an annular filter of activated carbon. The suction pump pulls airstreams into the hoods, which airstreams entrain ozone from proximate each corona device. The velocity of the air entraining the ozone is reduced in the plenum of the canister so that the air diffuses through the filter at a rate slow enough for the filter to be effective in removing the ozone therefrom.

9 Claims, 2 Drawing Sheets

OZONE REMOVAL SYSTEM

BACKGROUND OF THE INVENTION

1. Field of the Invention

This invention relates to an ozone removal system for removing ozone produced during operation of devices such as electrostatographic copiers and other types of reproducing machines, laser printers, and facsimile machine.

Devices which utilize electrostatographic processes, such as reproducing machines, laser printers, and facsimile machines, rely on corona discharge devices which emit corona ions. In such devices, corona ions are used for a number of purposes, such as charging photosensitive components uniformly in preparation for receiving images, transferring toner images from the photosensitive components to paper, and discharging photosensitive members in order to assist toner removal. In electrostatographic machines, the photosensitive members are most frequently configured as belts or drums.

In some electrostatographic copying machines, there may be as many as four corona discharge devices. For example, there may be one at a primary charge station for placing an initial charge on a film belt, and others at additional stations for paper charging, detack, and erasing charge from the film. As is well known, each corona discharge device produces ions which interact with oxygen in the air to form ozone. As is also well known, ozone presents a serious health hazard to people, especially people with ailments such as asthma. In addition, it exacerbates allergies, and can cause respiratory discomfort to even the healthiest of individuals. In view of these health hazards, there are now OSHA regulations requiring minimization of ozone emission. Moreover, ozone can deteriorate machinery and can be especially destructive to photosensitive elements such as the film belts employed in many electrostatographic copiers.

The prior art has addressed this problem in a number of ways. A typical ozone-removing device includes either activated carbon or a metal oxide as ozone adsorption agents. Generally, these devices are passive and are placed in the vicinity of ozone-producing components to remove any ozone which happens to drift into contact with the devices. In another approach, the ozone-absorbing device is placed in proximity to a ventilation exit; however, with this approach, ozone can accumulate in dead air locations since ozone is only removed if entrained in an air ventilation stream. With each of these approaches, the ozone-removing devices are relatively large, adding significantly to the size of the overall device.

For many reasons, it is advantageous to both minimize the overall size of office machines and to minimize the size of office machine components. When designing an office machine, the designer functions within size constraints, so the reduction in size of one component may allow the designer to add an additional feature or increase the size of another component. Moreover, if one can reduce the size of a component, the component can perhaps occupy a previously unused void or space within the machine.

While positioning an ozone-absorbing device at a ventilation exit may not consume as much space as positioning ozone-removing devices at every ozone-generating station, positioning at ventilation exits tends to increase the pressure drop and interfere with adequate ventilation of the machine. This can cause undesirable increases in temperature which can adversely affect the operation of the machine and reduce life of its components.

These problems are considered in the patent literature in U.S. Pat. No. 4,853,735 to Kodama et al. In Kodama et al., an ozone-transporting fan is provided for pushing a stream of air over an ozone-producing station to an ozone collection device positioned in front of a ventilating fan used for the entire machine. With the Kodama et al. device, the solution to the ozone problem affects other components of the machine in that the ozone-entraining airstream is blown over various components and evacuated by the general ventilation fan for the entire machine. In a device such as that of Kodama et al., exposure of various machine components to the ozone-containing stream is not entirely precluded so at least the possibility exists of eventual damage to machine components due to continual low level ozone exposure.

In view of the aforementioned considerations, there is a need for apparatus to minimize the deleterious effects of ozone emissions in devices such as office machines which utilize corona chargers.

SUMMARY OF THE INVENTION

It is an object of the instant invention to provide a new and improved apparatus for clearly and effectively collecting ozone generated in devices such as electrostatographic machines.

In view of this and other objects, the instant invention contemplates apparatus for collecting ozone produced by at least one localized station in such a machine. The apparatus comprises a hood disposed in proximity with the localized station and an ozone removal device, remote from the hood means and in fluid communication therewith. The ozone removal device includes an ozone-removing filter, and draws ozone ladened air locally from such station into the hood at a relatively high velocity into the removal device. To enhance the effectiveness of the ozone-removing filter, the velocity of the airstream is substantially reduced before such air is exhausted from the filter and into the atmosphere.

The afore-described apparatus is especially useful in electrostatographic reproducing machines having at least one corona discharge device.

The invention also contemplates the combination of an ozone-collecting apparatus with a reproducing machine having a film belt which is advanced in a closed loop past a plurality of corona discharging devices. The ozone-collecting apparatus includes hoods in proximity with each corona-discharging device and fluid connections for conveying ozone and air collected proximate the hoods to a central collection device. The central collection device draws air into the hoods to entrain ozone proximate the hoods in an airstream. Within the central collection device, the velocity of the airstream is decreased before filtering the airstream to remove the ozone therefrom.

In accordance with one embodiment of the invention, the ozone collection apparatus is positioned within the closed loop formed by the film belt.

In accordance with a more specific embodiment of the combination, the collection apparatus is configured as an annular canister with an inlet tube forming one wall of a plenum and a catalytic filter bed or a filter of activated carbon being positioned in spaced relation around the inlet tube to form both a second wall of the plenum and the outlet for the canister. In order to connect ozone-collecting hoods to the canister, an array of hoses connects each hood to a manifold, and a hose extends from the manifold to the inlet tube of the canister.

DETAILED DESCRIPTION OF THE PREFERRED EMBODIMENT

Figure 1:
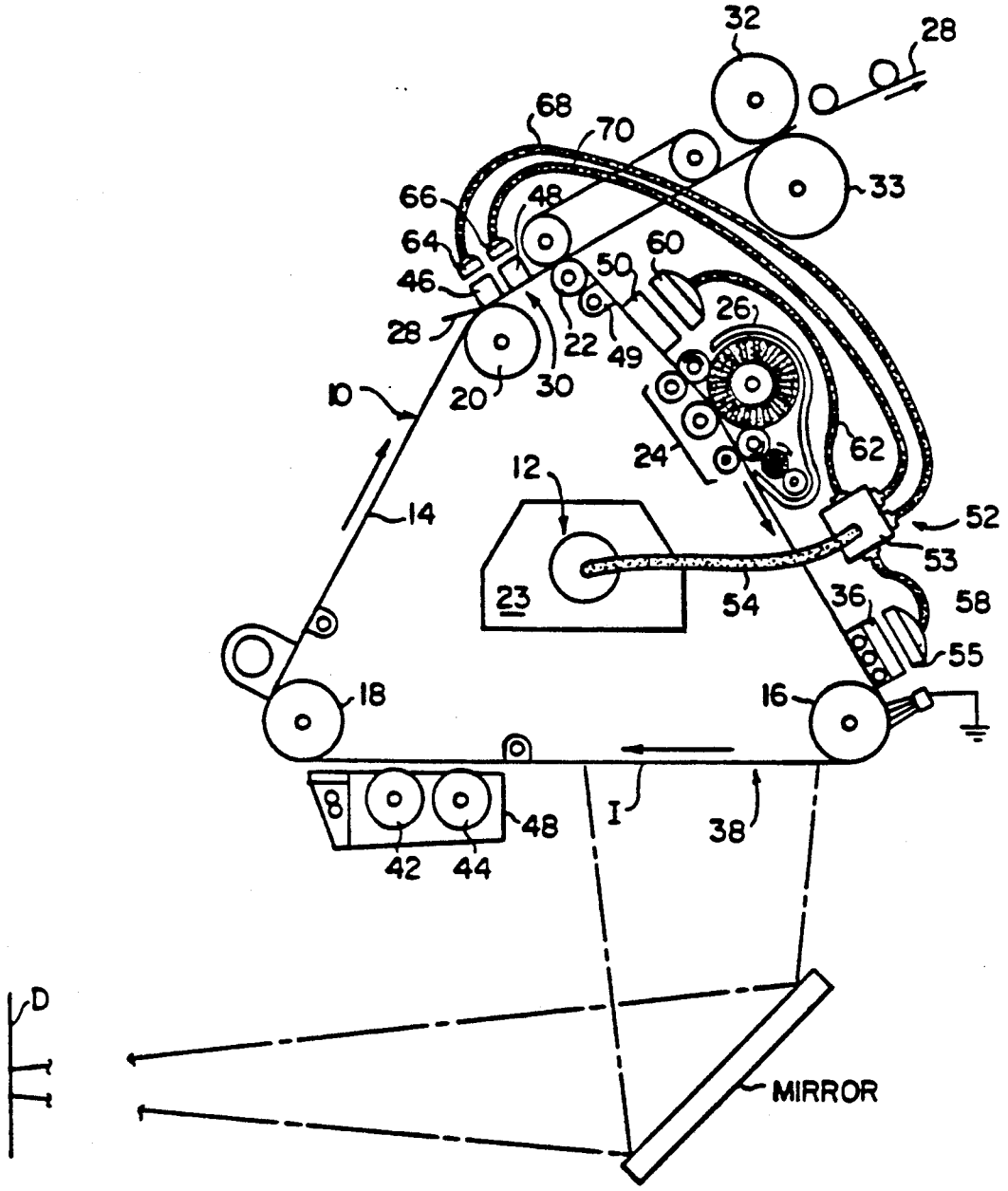
FIG. 1 is a schematic view of a portion of an electrostatographic reproducing machine including ozone collection apparatus configured and positioned in accordance with the principles of the instant invention.

Referring now to FIG. 1, there is shown a film core, designated generally by the numeral 10, of an electrostatographic reproducing machine, wherein the film core includes an ozone collection canister, designated generally by the numeral 12, configured and positioned in accordance with the principles of the instant invention to provide a central ozone collection station. The film core 10 includes a film belt 14, which is trained around a drive sprocket 16 and rollers 18, 20, and 22 to travel a substantially triangular loop defining a space 23 within which the canister 12 is positioned. Rollers 24 support the film belt 14 at a cleaning station 26 to remove residual toner from the film belt 14 after the toner developed images have been transferred to a suitable receiver such as a sheet of paper 28 at an image transfer station, designated generally by the numeral 30. The image transferred to the paper 28 is subsequently permanently fixed thereto by fusing rollers 32 and 33 while the toner image on the film belt 14 is thereafter erased and cleaned for reuse.

In order to repeatedly form and transfer images as above using the film belt 14, it is necessary to repeatedly charge and discharge the film belt 14 by exposing it to corona ions emitted by a number of corona discharge devices. Each time a corona discharge device is activated, it discharges corona ions which react with the air in proximity therewith, to convert some of the oxygen in such air to form ozone, which is both a legally recognized health hazard, as well as a corrosive agent to some machine elements.

As shown about the film core 10, a three-wire corona discharge device 36 is a primary charger and is positioned just upstream of the drive roller 16 for laying down a uniform charge on the surface of the film belt 14. The charged surface is then exposed to an image I of a document D in exposure area 38, which image is thereafter developed by toner applied at toner station 40 using magnetic brushes 42 and 44. A second corona discharge device 46 is positioned where the sheet of paper 28 is brought into contact with the film belt 14 at roller 20. The device 46 charges the paper 28 relative to the belt 14 thereby causing the toned image on the belt 14 to transfer onto the paper. Just downstream of the second corona device 46, there is a third corona device 48, which functions as a detack device or discharger, removing any charge from the back of the paper sheet 28. The copy paper 28 then separates easily from the film belt 14 after passing over support roller 22, and the film belt 14 proceeds back toward the drive sprocket 16. Just downstream of the roller 22, an erase lamp 49 exposes any residual toner particles on the surface of the film belt 14 to assist in their removal, while a fourth corona device 50 applies a corona charge to the film belt of opposite polarity to that of the first corona device 36 in order to discharge the film belt 14 and so release the residual toner still on the film belt. The film belt 14 is then cleaned of such residual toner at the cleaning station 26 before the belt 14 is again recharged by the first corona device 36.

Figure 2:
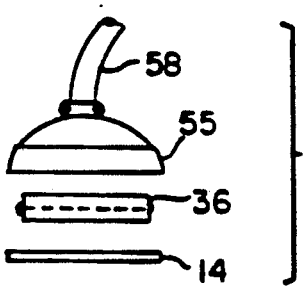
FIG. 2 is a cross section through one corona discharge station showing an ozone collection duct in accordance with the instant invention positioned above a corona discharge device.

Each time one of the corona devices 36, 46, 48, or 50 discharges corona ions, such ions interact with oxygen in proximity therewith to form ozone. In accordance with the principles of the instant invention, the ozone collection system 12 effectively and clearly collects the locally formed ozone before it can drift and contaminate either the air outside the machine or other areas within the machine. Such collection is accomplished by an array of hoods and hoses, designated generally by numeral 52, in fluid communication with the ozone removal canister 12 and connecting the canister with the environment proximate each of the corona devices 36, 46, 48, and 50. The array of hoods and hoses 52 are connected to a manifold 53, which is, in turn, connected via hose 54 to the ozone-removal canister 12. A first hood 55 is disposed over the three wire corona device 36 and connected to the manifold 53 by a hose 58. A second hood 60 is disposed over the erasing corona device 50 and is connected via hose 62 to the manifold 53. Third and fourth hoods 64 and 66, integral to, or positioned over corona devices 46 and 48, respectively, are connected by hoses 68 and 70, respectively, to the manifold 53. As is seen in FIG. 2, the hood 55 completely overlies the width of at least the charged portion of the film belt 14 and has a length sufficient to completely overlie the corona charger 36. Likewise, each of the hoods 60, 64, and 66 has a length and width sufficient to completely overlie its respective corona device 50, 46, and 48.

Figure 3:
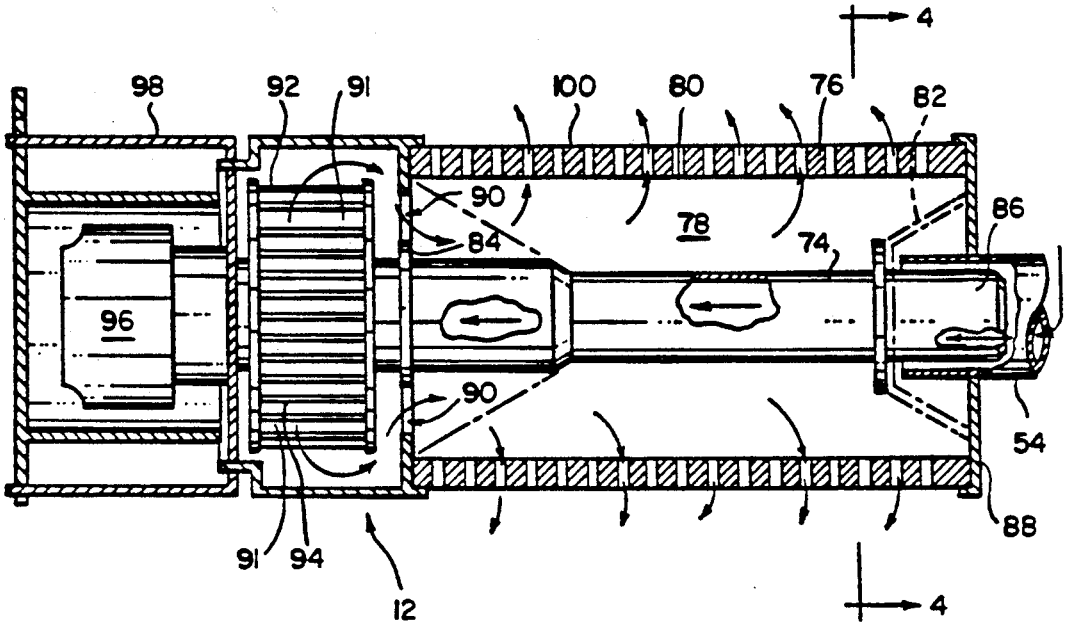
FIG. 3 is a side view, partially in section, with some components in phantom, of an ozone collection canister configured in accordance with the principles of the instant invention.
Figure 4:
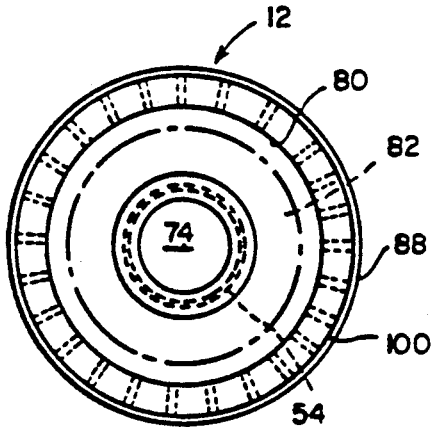
FIG. 4 is an end view of the canister of FIG. 2.

Referring now to FIGS. 3 and 4, it is seen that the ozone-removal canister 12 is circular in cross section and includes an axially extending, centrally disposed, inlet tube 74 to which the hose 54 from the manifold 53 is connected. The inlet tube 74 extends through the canister 12 in spaced relation to an annular filter 76 comprised of a catalytic filter bed or a porous bed of activated carbon. Between the inlet tube 74 and annular filter 76 is an annular plenum area 78, defined by a perforated annular wall 80, and first and second end walls 82 and 84. The end wall 82 is convex when viewed from outside the canister 12 so that the end portion 86 of inlet tube 74 provides a sufficient area for engaging the hose 54 without projecting a substantial distance beyond the end flange 88 of the canister. Wall 84 has openings 90 therethrough which communicate with radial openings 91 in a housing 92 for fan blades 94 driven by an electric motor 96. The fan blades 94 provide a suction pump for drawing air through the inlet tube 74. The electric motor 96 is retained within a housing 98 which dampens sound from the motor.

In operation, ozone-containing air collected in the manifold 53 is drawn through connecting hose 54 into the inlet tube 74 of the canister 12 as the fan blades 94 rotate. The fan blades 94 draw the air into housing 92, from which it is blown through the radial openings 91 of the housing and through openings 90 in the second end wall 84 of the plenum 78. Since the plenum 78 has a relatively large volume, the ozone-contaminated air expands in the plenum and passes at a relatively low velocity through the perforated wall 80 and the annular filter 76. An exterior perforated wall 100 surrounds the outside of the annular filter 76 and allows the slowly moving air to pass out of the canister 12 into the surrounding atmosphere. As the air and ozone diffuse through the annular filter 76, the ozone ($O_3$) is reduced by the catalytic filter bed or is adsorbed onto the surfaces of the activated carbon particles and is therein reduced, releasing molecular oxygen ($O_2$) and other atmospheric gases which then pass through the filter back into the machine and out therefrom.

With the arrangement of the instant invention, the localized air velocity through the annular filter 76 is generally below 50 feet/minute, which facilitates very high filter efficiency. Since the velocities through activated charcoal filters, for example, should not exceed 90 feet/minute for the charcoal to be effective, a velocity of 50 feet/minute ensures that ozone emitted from the film core 10 is prevented from spreading therein or reaching outside.

The entire disclosures of all applications, patents, and publications, cited herein, are hereby incorporated by reference.

From the foregoing description, one skilled in the art can easily ascertain the essential characteristics of this invention and, without departing form the spirit and scope thereof, can make various changes and modifications of the invention to adapt it to various usages and conditions.

What is claimed is:

1. Apparatus for collecting ozone produced at at least one localized station in a machine, comprising:

a hood means disposed in proximity with the localized station;

a collection device, remote from the hood means and fluid communication therewith, the collection device including ozone-removing means and means for drawing air into the hod means at relatively high velocity to entrain the ozone and to pull the air and entrained ozone into the collection device and means for substantially reducing the velocity of the airstream through the ozone-removing means, said airstream velocity reducing means including an inlet tube for drawing an airstream therethrough into the collection device, a plenum within said collection device relatively larger substantially than said inlet tube, said plenum being defined by said ozone-removing means about said inlet tube, and means for directing the drawn airstream from said inlet tube into said relatively larger plenum for exhaustion thereafter through said ozone-removing means.

2. The apparatus of claim 1, wherein there are a plurality of localized stations with hood means proximate each station and wherein each hood means is in fluid communication with the collection device.

3. The apparatus of claim 1, wherein the ozone-removing means is an annular filter comprising a porous bed of activated carbon.

4. In combination:

a reproducing machine, wherein the reproducing machine includes an image-bearing member advanced in a closed loop past a plurality of corona devices, each of which emits ozone; and an ozone-collecting apparatus, the ozone-collecting apparatus comprising:

hood means in proximity with each corona device and means for conveying ozone and air through the hood means to a central collection station wherein the central collection station includes: (a) means for drawing air into the hood means to entrain ozone proximate the hood means in an airstream, (b) means for decreasing the velocity of the airstream, and (c) a filter in communication with the means for decreasing the velocity of the airstream for filtering the airstream to remove the ozone therefrom, said airstream velocity reducing means including an inlet tube for drawing an airstream therethrough into the collection device, a plenum within said collection device substantially larger relatively than said inlet tube, said plenum being defined by said ozone-removing means about said inlet tube, and means for directing the drawn airstream from said inlet tube into said relatively larger plenum for exhaustion thereafter through said ozone-removing means.

5. The combination of claim 4, wherein the central collection station is positioned within the loop formed by the film belt.

6. The combination of claim 5, wherein the means for drawing air into the hood means is a tube having an air suction pump at one end and being connected at the other end to the ozone and air conveying means and wherein the filter is positioned in spaced relation to the tube to define a plenum therebetween into which the airstream flows, whereby the plenum provides the means for decreasing velocity of the airstream and the filter provides an outlet for the airstream.

7. The combination of claim 6, wherein the filter is comprised of an activated carbon bed.

8. The apparatus of claim 6, wherein the conveying means comprises an array of hoses connecting each hood means to a manifold and a hose extending from the manifold to the inlet tube of the canister.

9. The combination of claim 8, wherein the filter is comprised of an activated carbon bed.

* * * * *

UNITED STATES PATENT AND TRADEMARK OFFICE

CERTIFICATE OF CORRECTION

PATENT NO. : 5,087,943

DATED : February 11, 1992

INVENTOR(S) : Clyde M. Creveling

It is certified that error appears in the above-identified patent and that said Letters Patent is hereby corrected as shown below:

On the title page, In the Abstract line 52, after "in a" "look" should read --loop--.

Col 5, line 45, claim 1, after "into the" "hod" should read --hood--.

Signed and Sealed this

Twenty-first Day of September, 1993

Bruce Lehman

*Attest:*

BRUCE LEHMAN

*Attesting Officer*

*Commissioner of Patents and Trademarks*